US006029026A

United States Patent [19]

Natsume et al.

[11] Patent Number: 6,029,026

[45] Date of Patent: Feb. 22, 2000

[54] IMAGE FORMING APPARATUS CAPABLE OF EXECUTING A PLURALITY OF PROCESSES AT PROPER POSITION ON SHEET

[75] Inventors: Junko Natsume, Aichi-Ken; Hiroshi Yamada, Toyokawa; Kazuo Inui, Toyohashi, all of Japan

[73] Assignee: Minolta Co., Ltd., Osaka, Japan

[21] Appl. No.: 08/947,338

[22] Filed: Oct. 8, 1997

[30] Foreign Application Priority Data

Mar. 5, 1997 [JP] Japan ..... 9-050576

[51] Int. Cl.[7] ..... G03G 15/00

[52] U.S. Cl. ..... 399/82; 270/58.07; 345/902; 358/448; 358/453; 399/407; 399/410

[58] Field of Search ..... 399/81, 82, 407–410; 270/58.07, 58.08; 358/448, 463; 345/902

[56] References Cited

U.S. PATENT DOCUMENTS 4,763,167 8/1988 Watanabe et al. ..... 399/410
5,290,020 3/1994 Matsui et al. ..... 270/58.07
5,602,651 2/1997 Tabata et al. ..... 358/448
5,678,135 10/1997 Fukui et al. ..... 399/81

FOREIGN PATENT DOCUMENTS 7-196232 1/1995 Japan .

*Primary Examiner*—William J. Royer
*Attorney, Agent, or Firm*—McDermott, Will & Emery

[57] ABSTRACT

An image forming apparatus is capable of performing a plurality of processes for a sheet provided with an image such as stapling and punching. When two different processes are set together, the image forming apparatus displays a particular screen for making a user select positions for these processes. Thus, the incidence of setting errors can be reduced when the user sets the two processes in combination with each other.

30 Claims, 18 Drawing Sheets

IMAGE FORMING APPARATUS CAPABLE OF EXECUTING A PLURALITY OF PROCESSES AT PROPER POSITION ON SHEET

BACKGROUND OF THE INVENTION

1. Field of the Invention

The present invention relates to an image forming apparatus, and more particularly, it relates to an image forming apparatus which can execute a plurality of processes on a paper provided with an image.

2. Description of the Related Art

In relation to an image forming apparatus such as a copying machine, processes such as stapling and punching on a paper after forming an image thereon are known. Also known is a copying machine which can set the position of a binding margin.

Japanese Patent Laying-Open No. 7-196232 (1995) discloses a technique of determining whether or not the relation between a position for forming a binding margin and that for stapling is defective and informing the user of the result of the determination. According to this technique, it is possible not only to inform the user of the result of determination but to inhibit an operation of image formation on the basis of the result for unerringly stapling the paper on the position for forming a binding margin.

In the aforementioned technique disclosed in Japanese Patent Laying-Open No. 7-196232, however, it is hard to understand what setting is to be concretely made for removing the defectiveness, although the user can recognize that the relation between the position for forming a binding margin and that for stapling is defective. Thus, a warning message may be issued to allow no image formation even if the user performs a series of resets.

Further, an image forming apparatus has so many functions nowadays that it is difficult to combine the functions (processes) with each other.

SUMMARY OF THE INVENTION

Accordingly, an object of the present invention is to provide an image forming apparatus which can simply set functions when executing a plurality of processes in combination with each other.

Another object of the present invention is to readily set automatic stapling and automatic punching.

The aforementioned objects of the present invention are attained by an image forming apparatus including a set unit alternatively or simultaneously setting a first process which is performed on a sheet provided with an image and a second process which is different from the first process. The set unit selectively sets a position on the sheet to be subjected to the first process from a plurality of positions while selectively setting a position on the sheet to be subjected to the second process from a plurality of positions. The image forming apparatus further includes a display unit selecting only proper combinations from combinations of the plurality of positions to be subjected to the first process and the plurality of positions to be subjected to the second process and displaying the same when the set unit simultaneously sets the first and second processes.

According to the present invention, the image forming apparatus selects proper combinations from those of a plurality of positions and displays the same when executing the first and second processes in combination with each other, whereby improper setting can be prevented.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment of the present invention is now described with reference to the drawings.

<Structure of Copying Machine>

Figure 1:
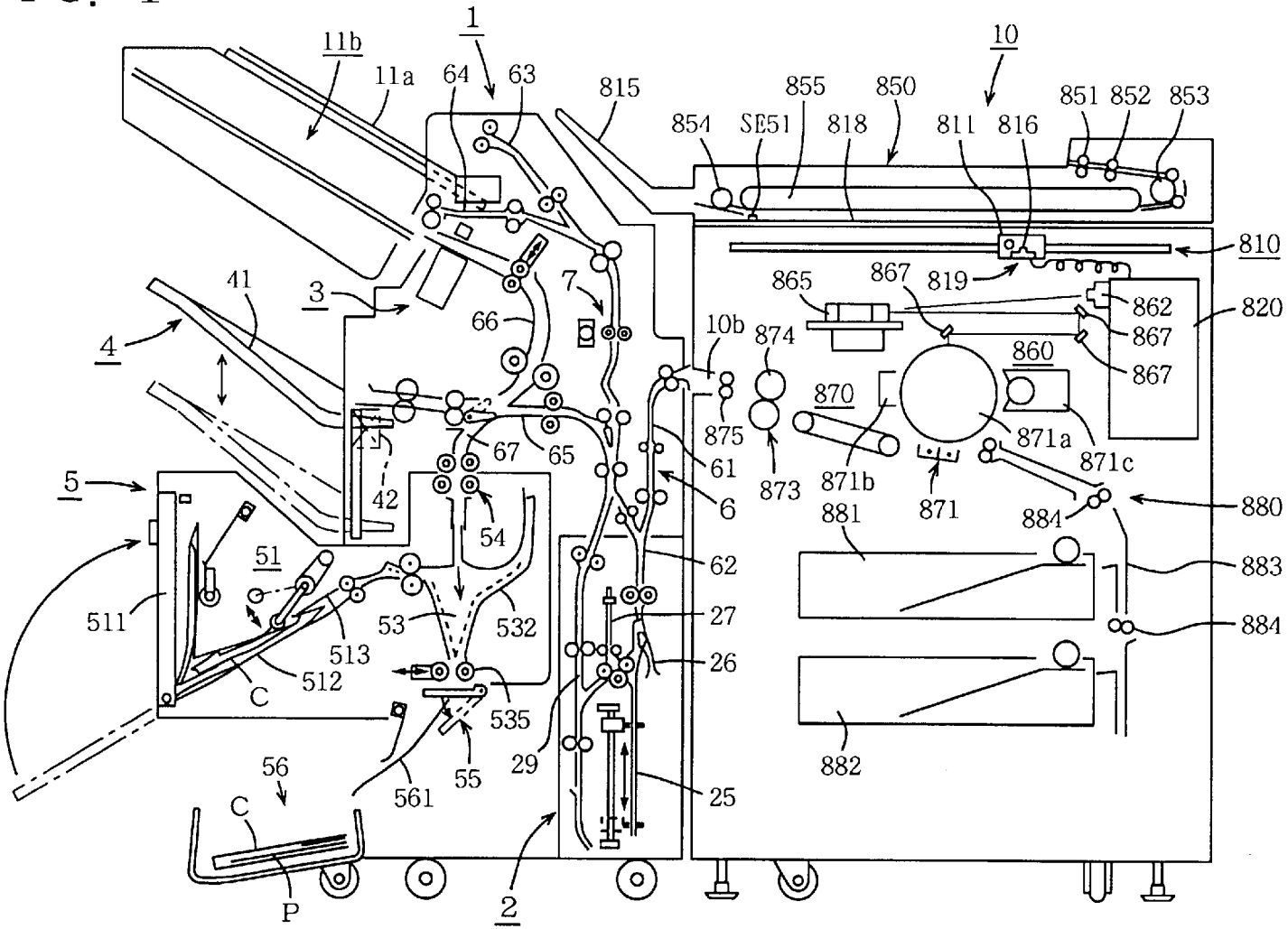
FIG. 1 illustrates the overall structure of a copying machine provided with a finisher according to an embodiment of the present invention.

Referring to FIG. 1, a copying machine 10, called a digital copying machine, is roughly formed by a scan system 810 reading originals to be copied, an image signal processing part 820 processing read image data, a laser optical system 860 for outputting the read image data onto papers, and an image forming system 870. An ADF (automatic document feeder) 850 is provided on an upper portion of the copying machine 10 for feeding the originals to be copied and reversing the same at need. An operation panel OP is provided on an upper surface of the copying machine 10, for setting various operation modes for image edit processing performed in the copying machine 10, the number of copy papers and the like.

A finisher 1 provided a binding part, a paper folding part, a punching part and a stapling part as described later is mounted on this copying machine 10.

Figure 2:
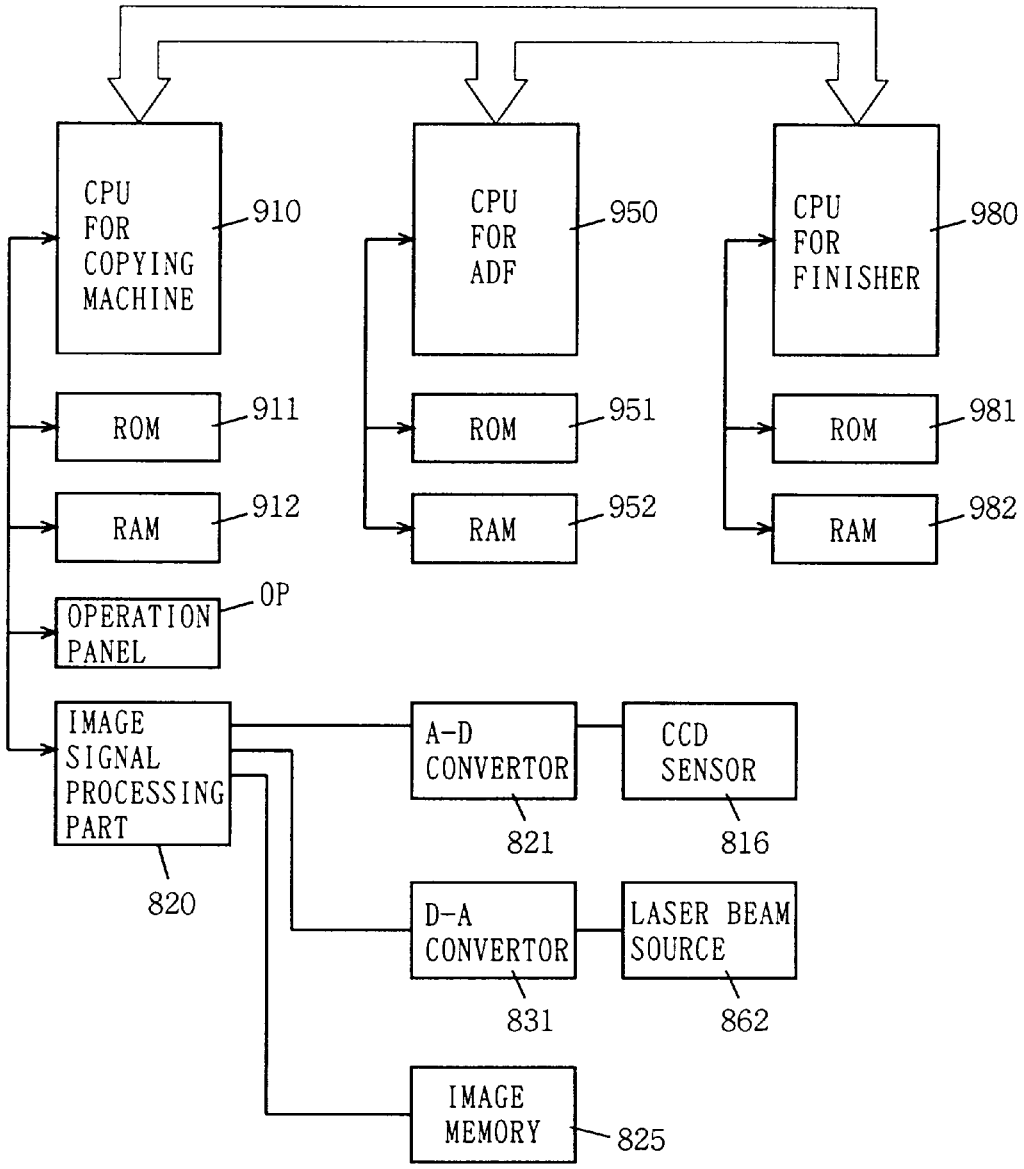
FIG. 2 is a block diagram showing a control system of the copying machine.

As shown in FIG. 2, a control system controlling operations of the overall copying machine 10 including the ADF 850 and the finisher 1 is formed by CPUs 910, 950 and 980 for controlling the copying machine 10, the ADF 850 and the finisher 1 respectively. These CPUs 910, 950 and 980 are provided with ROMs 911, 951 and 981 storing necessary programs and RAMs 912, 952 and 982 employed for various processes respectively.

The operation panel OP and the image signal processing part 820 are connected to the CPU 910 for the copying machine 10. Operations of the respective parts of the copying machine 10 are performed by commands from the CPU 910 for the copying machine 10. A CCD sensor 816 is connected to the image signal processing part 820 through an A-D converter 821. Further, a laser beam source 862 of the laser optical system 860 is also connected to the image signal processing part 820 through a D-A converter 831. In addition, the image signal processing part 820 is provided with an image memory 825 for storing the read image data.

Functions and operations of the respective parts of the copying machine 10 are now described in detail.

First, originals which are set on an original tray 815 of the ADF 850 are fed one by one to a prescribed position on a platen glass member 818 by a command from the CPU 950 for the ADF 850. The originals are read by the scan system 810, and thereafter discharged on a discharge tray provided on the ADF 850. Original feed rollers 851, 852, 853 and 854 and a transport belt 855 of the ADF 850 are driven to feed the originals.

When the originals are fed, the sizes thereof are detected one by one in response to ON/OFF time of a sensor SE51 which is set in the ADF 850. Signals from the sensor SE51 are transmitted to the CPU 910 for the copying machine 10 through the CPU 950 for the ADF 850.

In the scan system 810, a scanner 819 is driven by a scan motor (not shown). The scanner 819 moves under the platen glass member 818. An exposure lamp 811 mounted on the scanner 819 irradiates each original which is placed on the platen glass member 818 with light. The CCD sensor 816 which is a photoelectric conversion element receives reflected light, for scanning/reading original images.

The laser optical system 860 is formed by the laser beam source (semiconductor laser) 862, a polygon mirror 865 deflecting the laser beam, and reflecting mirrors 867. The image forming system 870 is formed by a develop/transfer system 871, a feeding system 880 for feeding the papers, and a fixing system 873 for fixing the images. The develop/transfer system 871 is formed by a photoreceptor drum 871*a*, a corona charger 871*b*, a developing unit 871*c* storing a developer and supplying toner to the photoreceptor drum 871*a*, a transfer charger (not shown) for transferring toner images formed on the photoreceptor drum 871*a* to the papers, a paper separation charger (not shown) for separating the papers from the photoreceptor drum 871*a*, and a cleaning plate (not shown) for removing unnecessary part of the toner from the photoreceptor drum 871*a*.

The feeding system 880 is formed by cassettes 881 and 882 storing papers, a paper guide 883, timing rollers 884 and the like. The sizes of the papers stored in the cassettes 881 and 882 are previously decided so that the paper sizes are determined in response to the cassettes 881 and 882 respectively. While FIG. 1 shows two cassettes 881 and 882, the copying machine 10 may comprise three or more cassettes.

The fixing system 873 is formed by fixing rollers 874 for feeding the papers while thermocompressing the same, discharge rollers 875, and a discharge sensor (not shown) for detecting paper discharge.

Printed papers are transmitted from a paper discharge part 10*b* to the finisher 1 described later.

<Schematic Structure of Finisher 1>

Figure 3:
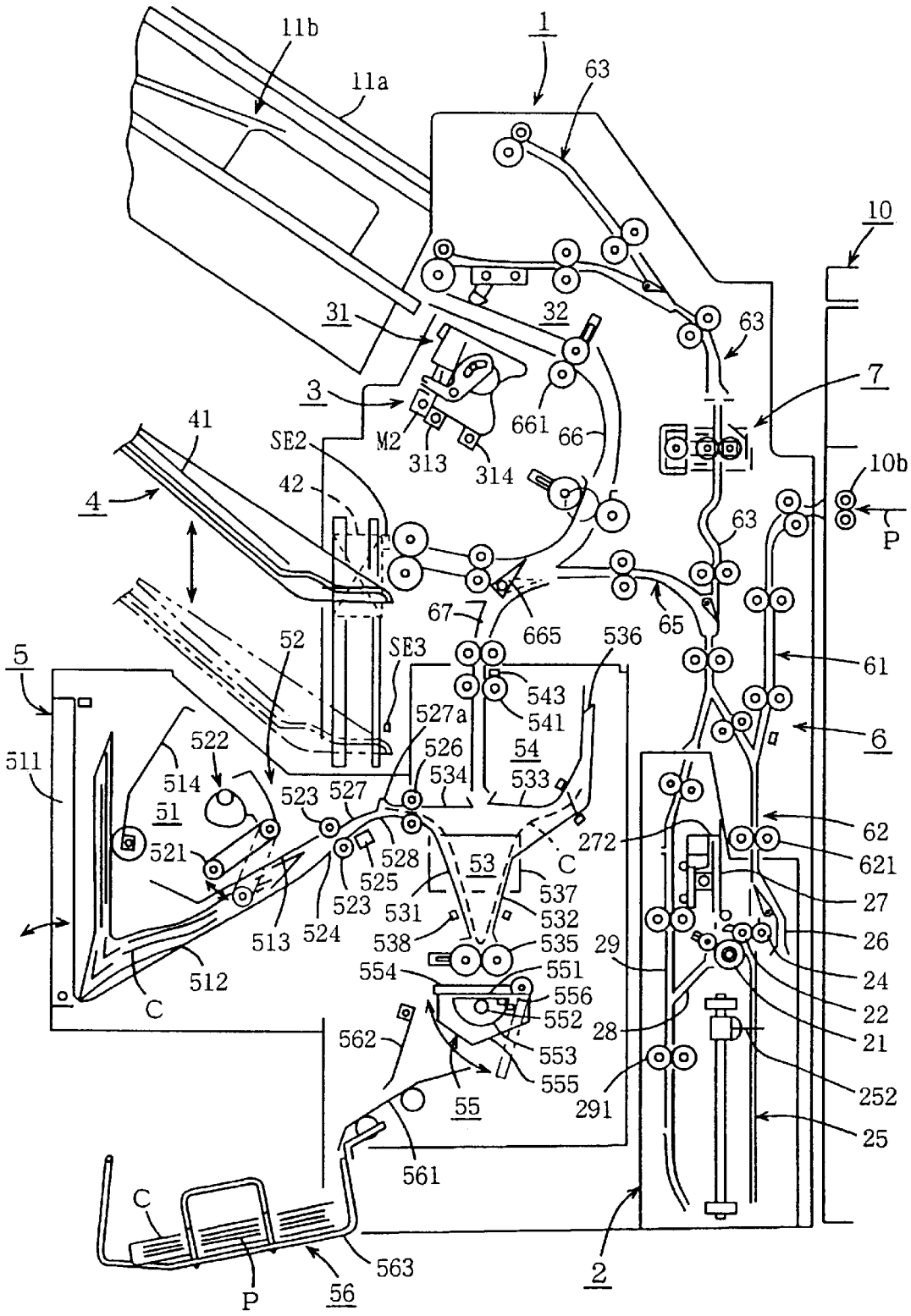
FIG. 3 illustrates the structure of the finisher.

FIG. 3 is an enlarged view of the finisher 1. As shown in FIGS. 1 and 3, the finisher 1 is roughly formed by a non-sort tray 11*a* and a paper integration part 11*b* for integrating and aligning papers P discharged from the paper discharge part 10*b* of the copying machine 10, a paper folding part 2 for folding the papers P discharged from the paper discharge part 10*b* in two or in the form of Z (hereinafter referred to as Z folding) at need, a stapling part 3 which is set downstream the paper integration part 11*b* along the paper feed direction for stapling the integrated and aligned papers P, a sort part 4 for receiving and storing a bunch of the stapled papers P, a binding part 5 for covering the stapled paper bunch or an unstapled paper bunch, and a punching part 7 provided on a paper feeding path for punching the papers P at need. The papers P discharged from the copying machine 10 are fed to the respective parts in the finisher 1 by a paper feeding part 6.

<Sort Part>

As shown in FIGS. 1 and 3, the sort part 4 has a sort tray 41 and a drive 42 for vertically moving the sort tray 41. The papers P are fed to the sort tray 41 one by one through a feeding path 65 in mass copying, or the paper bunch which are fed from the paper integration part 11*b* to the stapling part 3 and stapled is fed to the sort tray 41 through a feeding path 66. The papers P or the paper bunch fed from the feeding path 65 or 66 is guided to the sort tray 41 or the binding part 5 by a switching pawl 665.

Every time a sensor SE2 detects a paper P stored and placed on the sort tray 41, the drive 42 moves the sort tray 41 downward by a constant amount. When a sensor SE3 detects movement of the sort tray 41 to the lower limit, the copying operation is interrupted since the sort tray 41 is full in this state. The structure of the drive 42 for moving the sort tray 41 downward is well known in the art and hence description thereof is omitted.

<Paper Folding Part>

Figure 4:
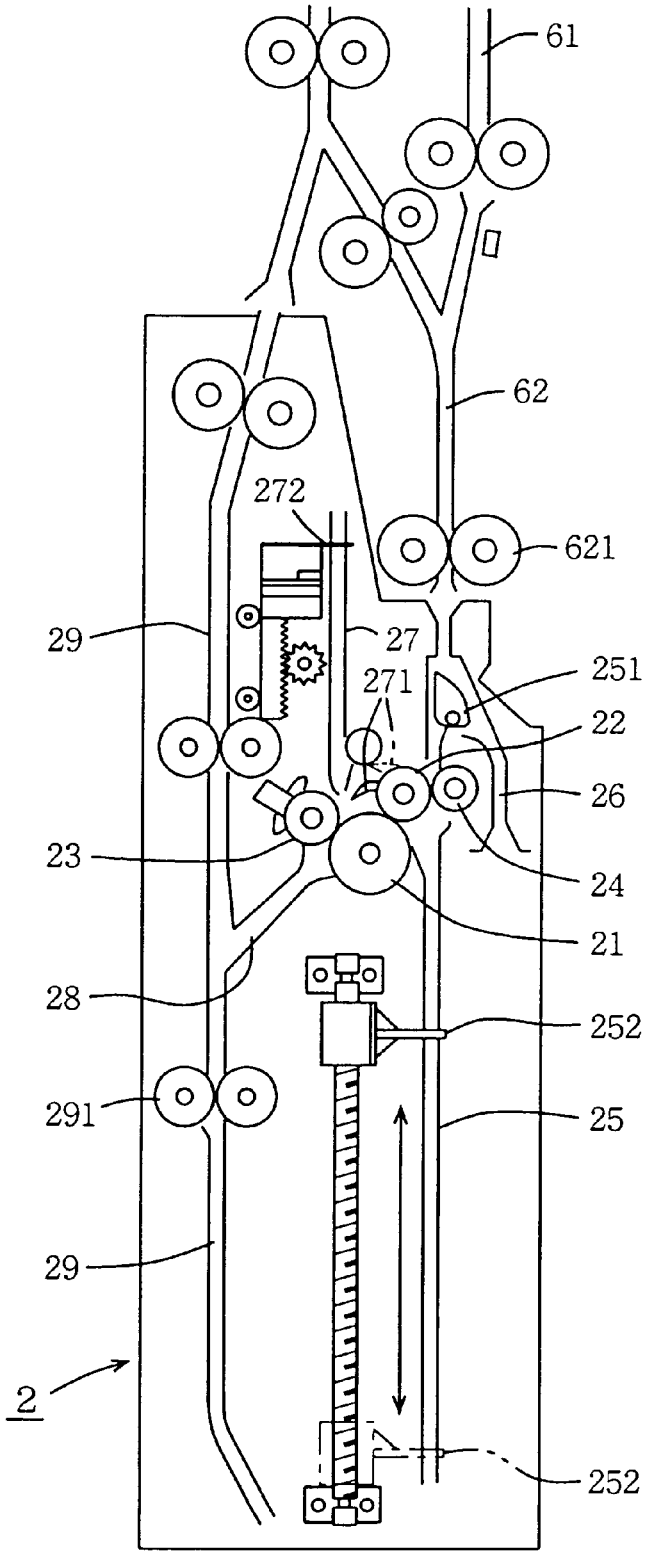
FIG. 4 is an enlarged view showing a paper folding part.

FIG. 4 is an enlarged view of the paper folding part 2. As shown in FIGS. 3 and 4, the paper folding part 2 is provided immediately under the paper feeding part 6. The paper folding part 2 has a function of folding each paper P provided with an image in two at the center of the paper feed direction, and a function of folding each paper P in the form of Z.

Principal parts of the paper folding part 2 are three reversible paper folding rollers 21, 22 and 23 and a backup roller 24. The papers P are transferred through a plurality of paper feeding paths 25 to 29 along the rollers 21 to 24.

The paper folding functions are now described.

The paper folding part 2 has two paper folding modes which can be selected by manipulating the operation panel OP of the copying machine 10.

[Z Folding Mode]

This mode is adapted to fold each paper P in the form of Z. As shown in FIG. 4, the paper P fed from the discharge part 10*b* through feeding paths 61 and 62 is passed through a switching member 251 and fed toward the first feeding path 25 by a pair of switchback rollers 621. The paper P is temporarily stopped by the paper folding roller 22 and the backup roller 24 which are stopped. When the paper folding roller 22 is driven, the paper P is fed to come into contact with a stopper 252 which is set on a prescribed position. When coming into contact with the stopper 252, the paper P defines a loop in the vicinity of the paper folding rollers 21 and 22. This loop is nipped by nippers of the paper folding rollers 21 and 22, to be subjected to first folding.

In response to Z folding order command from the copying machine 10, paper P subjected to the first folding is fed to the second feeding path 27 by a switching operation of a switching member 271, to come into contact with another stopper 272. The paper P stopped by this stopper 272 defines a loop in the vicinity of nippers of the paper folding rollers 21 and 23. This loop is nipped by the nippers of the paper folding rollers 21 and 23, to be subjected to second folding. The paper P subjected to the second folding and folded in the form of Z is fed to the third feeding path 28, and further fed toward the switchback feeding path 29. A pair of switchback rollers 291 are reversed to feed the paper P toward a feeding path 63.

[Two-Folding Mode]

This mode is adapted to fold each paper P in two at its center. In this mode, first folding is performed through a process similar to that in the Z folding mode, except the position of the first stopper 252.

The switching member 271 provided on an inlet of the second feeding path 27 is not rotated to guide the paper P to the second feeding path 27, and hence the paper P subjected to the first folding is directly fed toward the nippers of the paper folding rollers 21 and 23. Namely, the paper P passed through the paper folding rollers 21 and 22 is immediately nipped by the nippers of the paper folding rollers 21 and 23, and directly fed to the third feeding path 28. Thereafter the paper P is fed to the switchback feeding path 29, and then fed toward the feeding path 63 by the pair of switchback rollers 291, similarly to the Z folding mode. Thus, the paper P is fed while directing the folded side downward.

<Stapling Part>

Figure 5:
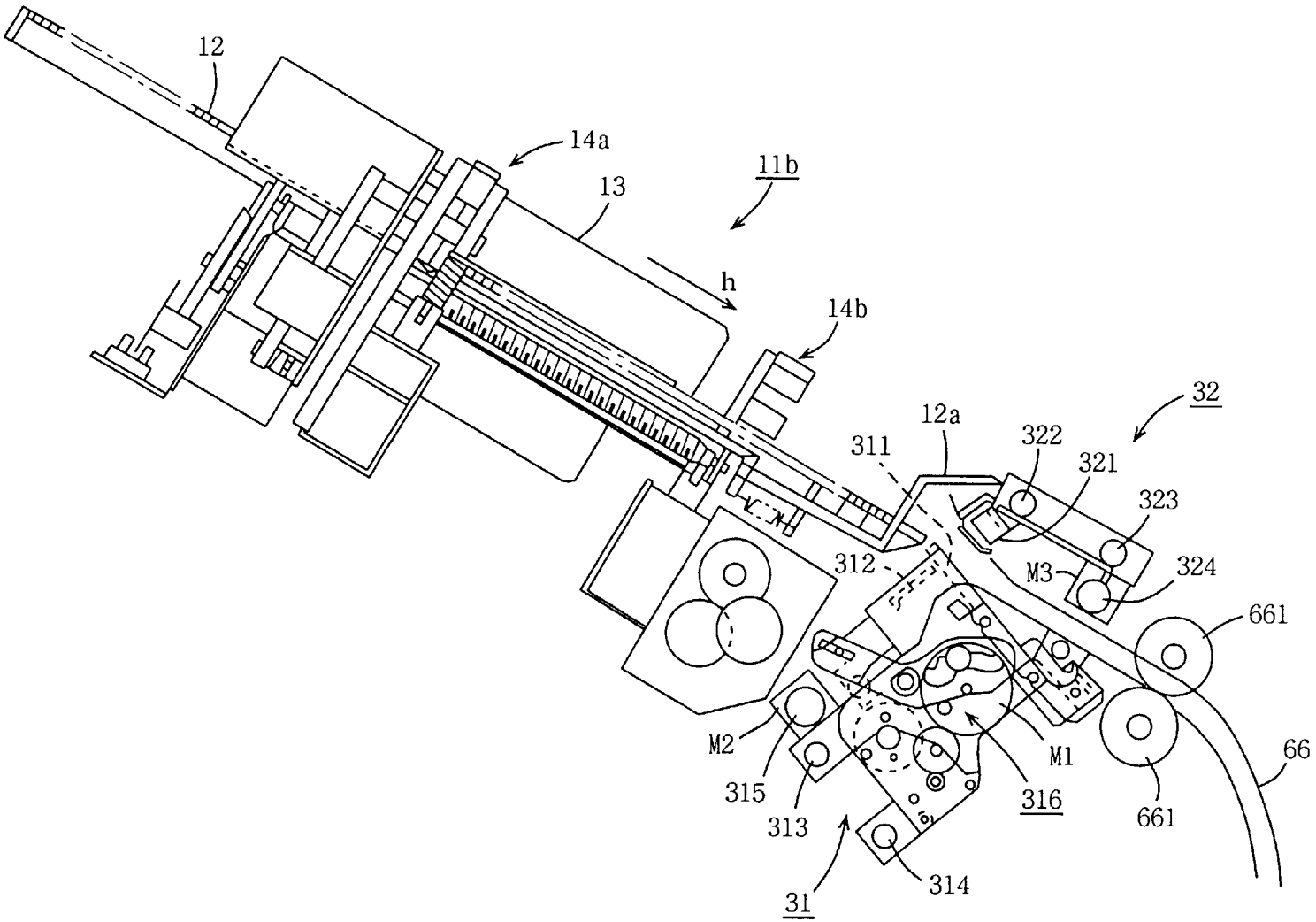
FIG. 5 is an enlarged view showing a stapling part.

FIG. 5 is an enlarged view of the stapling part 3. As shown in FIGS. 2 and 5, the papers P discharged from a feeding path 64 are aligned in the paper integration part 11*b*, so that prescribed positions of the paper bunch are stapled. The stapling part 3 has a staple delivery part 31 for delivering staples, and a staple receiving part 32 for receiving and bending the delivered staples.

In the paper integration part 11*b*, a forward end stopper 12*a* receives and aligns forward ends (rear ends as viewed from the direction of discharge to the tray 12) of the papers P discharged onto the tray 12, and a side portion aligning plate 13 reciprocates perpendicularly to the paper feed direction for aligning transverse directions of the papers P. In covered binding, therefore, the folded sides of the papers P are directed toward the forward end stopper 12*a*. First and second chucking parts 14*a* and 14*b* alternately grasp side portions of the papers P for preventing the papers P from floating, while the first chucking part 14*a* grasps the paper bunch and feeds the papers P toward the stapling part 3.

The staple delivery part 31 drives a staple cutting member and a staple bending member 312 through a cam link mechanism 316 which is driven by a motor M1, for cutting the staples stored in a staple cartridge 311 one by one, separating the same from each other and discharging the separated staples toward the staple receiving part 32. The staple receiving part 32 has a staple receiving member 321 for bending the staples in a U-shaped manner and binding the paper bunch.

The staples are driven perpendicularly to the paper feed direction h as follows: The staple delivery part 31 is slidably mounted on two guide shafts 313 and 314, and rendered movable following normal/reverse rotation of a spiral shaft 315 which is provided perpendicularly to the paper feed direction h by a stepping motor M2. The staple receiving part 32 is also slidably mounted on two guide shafts 322 and 323, and moved perpendicularly to the paper feed direction h following normal/reverse direction of a spiral shaft 324 which is driven by a stepping motor M3.

Positions for driving the staples in the paper feed direction h are decided in response to the movement of the papers P by the chucking part 14*a*. Thus, the integrated papers P can be stapled in any positions between the forward ends and the rear ends thereof in response to the amount of delivery of the first chucking portion 14*a*. In case of covered binding, end portions (forward ends as viewed from the direction of discharge to the tray 12) of the papers P folded in two are thrusted to reach the position of the staple delivery part 31.

After the stapling, the papers P are held by a pair of feed rollers 661 which are rendered separable from each other, and fed through the feeding path 66.

<Binding Part>

The binding part 5 is adapted to bunch the papers P after copying and paste the same with a commercially available cover. As shown in FIG. 3, the binding part 5 is formed by a cover storage part 51 storing a plurality of commercially available binding covers C, a cover feeding part 52 for taking out a cover C from the cover storage part 51 and feeding the same, a paper insertion part 53 for holding the cover C fed by the cover feeding part 52 in a paper receiving state, a paper feeding part 54 for inserting the paper bunch discharged from the paper discharge part 10*b* and fed through a feeding path 67 into the cover C, a heating part 55 for heating the cover C receiving the papers P in the paper insertion part 53, and a discharge part 56 for discharging the bound cover C to the exterior of the binding part 5 and storing the same.

Thus, the paper bunch aligned in the paper integration part 11*b* is fed to the binding part 5 through the feeding paths 66 and 67 as such or after stapling to be bound, or the papers P folded by the paper folding part 2 are fed one by one to the binding part 5 through the feeding path 65 to be bunched and bound.

In a space of the cover storage part 51 for storing the covers C, each cover C is stored in a V-shaped open state (the state shown in FIG. 3) by an open/close door 511, a cover holding member 514 and storage lower guide plates 512 and 513.

The cover feeding part 52 has a pickup roller 521 which comes into contact with front and rear surfaces of each cover C stored in the cover storage part 51 for feeding the forward end thereof, a roller pressing member 522 for pressing the pickup roller 521 against the cover C under pressure, a pair of separation rollers 523 for feeding only a single cover C, a preseparation member 524 arranged upstream the pair of separation rollers 523, a cover detection part 525 arranged downstream the pair of separation rollers 523, a pair of cover feed rollers 526 arranged downstream the pair of separation rollers 523, and cover feeding guides 527 and 528 which are formed to connect the cover storage part 51 with the paper insertion part 53.

The paper insertion part 53 is formed by guide plates 531, 532, 533 and 534 defining an inverted triangular paper insertion space, a pair of cover resist rollers 535 arranged under the paper insertion space, a forward end stopper 536 arranged above the paper insertion space along the cover feed direction, and a transverse aligning member 537 arranged in the paper insertion space above the pair of cover resist rollers 535.

The forward end of the cover C fed by the cover feeding part 52 is moved upward along the guide plate 512, to come into contact with the forward end stopper 536. Further, the cover C is so fed that its back portion is bent downward, and passed through the guide plates 531 and 532 so that its lower end is regulated by the pair of cover resist rollers 535.

The cover detection part 538 provided above the pair of cover resist rollers 535 detects passage of the cover back portion, and after a constant time (when the cover back portion is in contact with the pair of cover resist rollers 535 and the cover rear end is upstream the pair of cover feed rollers 526), at least the upper one of the pair of cover feed rollers 526 retracts from the cover feeding path.

Due to the retraction of at least one of the cover feed rollers 526, the rear end of the cover C engages with a concave portion 527*a* of the cover feeding guide 527 due to its toughness. Thus, the rear end position of the cover C is regulated so that its back portion is set in the paper insertion part 53 in a state placed on the pair of cover resist rollers 535 in a V-shaped manner.

After the cover C is set in the paper insertion part 53, the transverse aligning member 537 moves perpendicularly to the cover feed direction. Thus, the cover end surface is pressed against an alignment reference plate (not shown) which is opposed to the transverse aligning member 537, so that its position is regulated.

The paper feeding part 54 has the feeding path 67 which is extended to a portion above the pair of cover resist rollers 535, a pair of feed rollers 541 for feeding the paper bunch to the paper insertion part 53, and a detection part 543 for detecting the papers P in the feeding path 67. The paper bunch fed by the pair of feed rollers 541 falls by its own weight in the cover C opening upward in the paper insertion part 53. End portions of the papers P to be stuck to each other are aligned with each other by this falling.

The heating part 55 is formed by a heating plate 551 for heating the back portion of the cover C fed from the paper insertion part 53, a heater 552 arranged under the heating plate 551, a reflector 553 which is formed to enclose a lower portion of the heater 552 for concentrating the heat of the heater 552 to the heating plate 551, a heater support plate 554 integrally holding the heating plate 551, the heater 552 and the reflector 553, a shielding adiabatic member 555 which is mounted on the heater support plate 554, and a temperature detection part 556.

When the paper bunch is inserted in the cover C in the paper insertion part 53, the pair of cover feed rollers 526 press end portions of the cover C, and thereafter at least one of the pair of cover resist rollers 535 retracts from the paper insertion space. The pair of cover resist rollers 535 are normally rotated to simultaneously rotate the pair of cover feed rollers 526, for introducing the cover C and the paper bunch into the heating part 55 under the paper insertion part 53. Driving of the pair of cover feed rollers 526 and the pair of cover resist rollers 535 is stopped, and the pair of cover feed rollers 526 separate from each other while the pair of cover resist rollers 535 simultaneously press the cover C and the paper bunch. Thus, the end portions of the paper bunch in the cover C are further aligned with each other.

Thereafter the cover back portion is heated on the heating plate 551 at a proper temperature for a constant time while the pair of cover resist rollers 535 press the cover C and the paper bunch thereby melting an adhesive fixed to the cover back portion and sticking the cover C and the paper bunch to each other. Thereafter the pair of cover resist rollers 535 are normally rotated to discharge the cover C and the paper bunch after a time reliably sticking the same to each other.

The discharge part 56 is formed by a discharge guide 561, a close plate 562 and a discharge tray 563, so that the cover C fed from the heating part 55 slips down along the inclined discharge guide 561 by its own weight to be stored in the discharge tray 563.

<Operation Panel OP>

Figure 6:
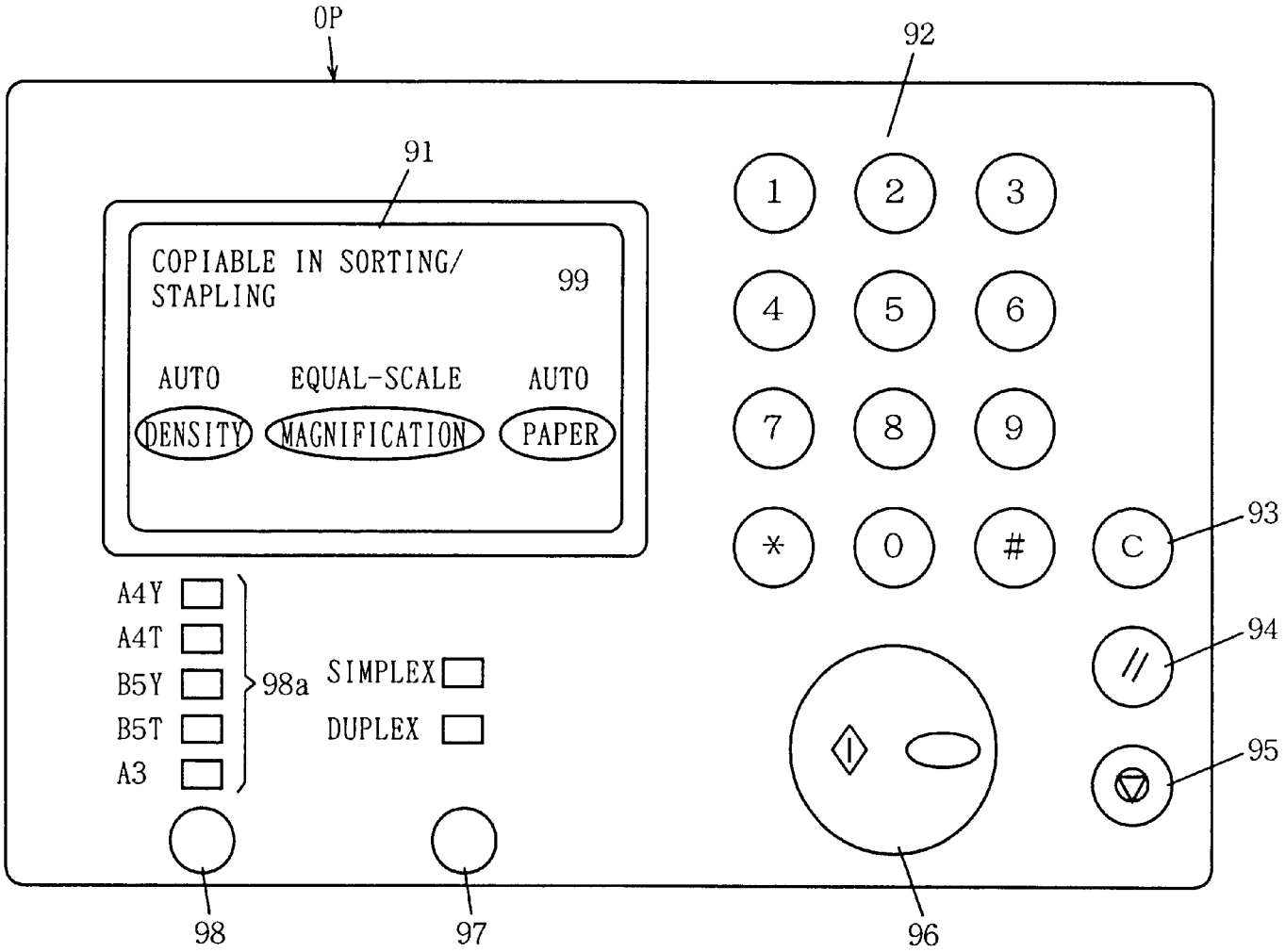
FIG. 6 is a plan view showing an operation panel.

FIG. 6 is a front elevational view of the operation panel OP. Referring to FIG. 6, the operation panel OP is provided with a liquid crystal touch panel 91, ten keys 92 for inputting a numeric value and a magnification, a clear key 93 for returning the numeric value to a standard value "1", a panel reset key 94 for returning set values etc. in the copying machine 10 to standard values, a stop key 95 for stopping the copying operation, a start key 96 for starting the copying operation, a mode set key 97 for setting a copy mode, and a paper selection key 98 for selecting the paper size. When the size of the supplied papers is selected by the paper selection key 98, a paper display part 98*a* displays the selected size. For example, "A4Y" indicates transverse setting of A4 papers, and "B5T" indicates vertical setting of B5 papers. The longitudinal direction of transversely set papers is perpendicular to the paper feed direction, and that of vertically set papers is identical to the paper feed direction.

The liquid crystal touch panel 91 displays various states of the copying machine 10 such as a jamming state, a serviceman call state and a paper empty state, operation modes of the copying machine 10 such as the exposure level, the magnification and the paper size and other information, and is employed for selecting the operation modes.

<Concrete Action of Finisher 1>

The concrete action of the finisher 1 is now described.

Figure 7:
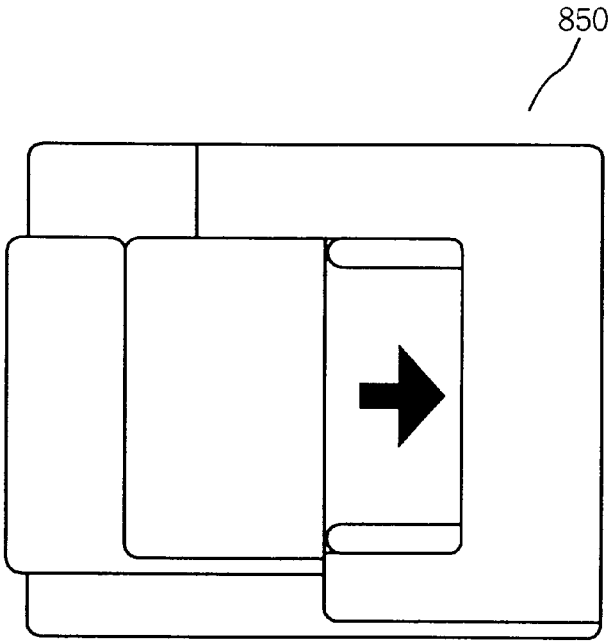
FIG. 7 is a plan view showing an ADF.

FIG. 7 is a plan view of the ADF 850. Referring to FIG. 7, the user sets an original to be copied along arrow while directing the surface to be copied upward.

Figure 8:
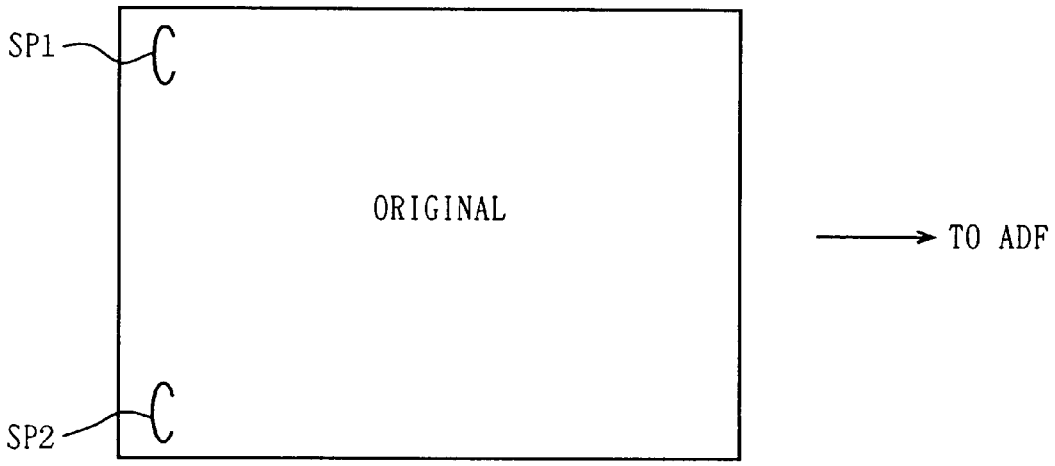
FIG. 8 is adapted to illustrate positions allowing corner stapling.

FIG. 8 is adapted to illustrate corner stapling by the stapling part 3.

This figure shows the relation between the direction of the original set on the ADF 850 and positions SP1 and SP2 for stapling copy papers for the original.

When a corner stapling function is set, corners of the papers are stapled after copying. The position SP1 or SP2 is selected as the position for stapling.

Figure 9:
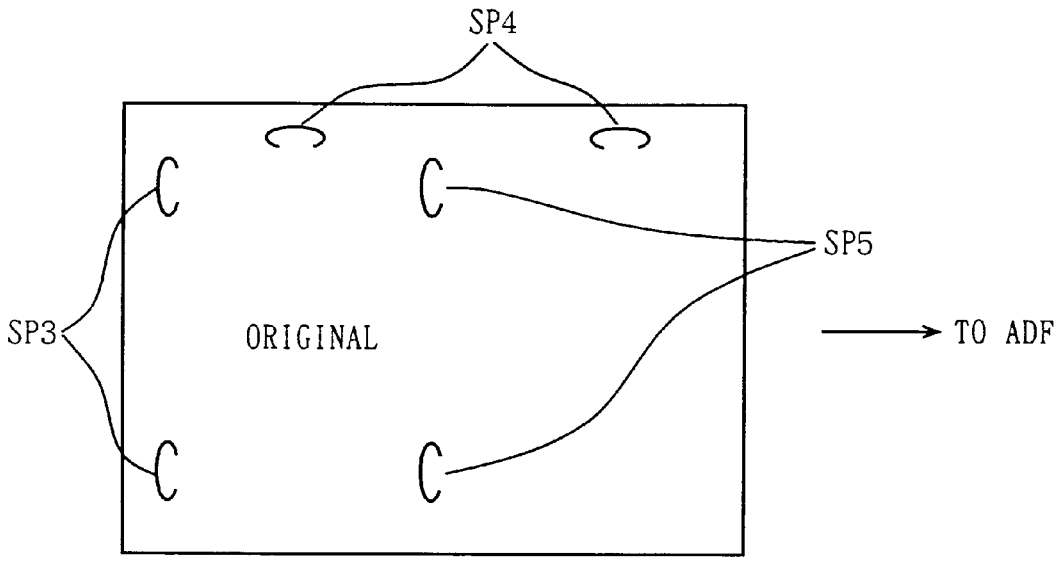
FIG. 9 is adapted to illustrate positions allowing two-point stapling.

FIG. 9 is adapted to illustrate two-point stapling. When a two-point stapling function is set, two points of each paper are stapled after copying.

Positions SP3, SP4 or SP5 are selected as the positions for stapling. Papers stitched at the positions SP5 can form a book when bent along the positions SP5.

Figure 10:
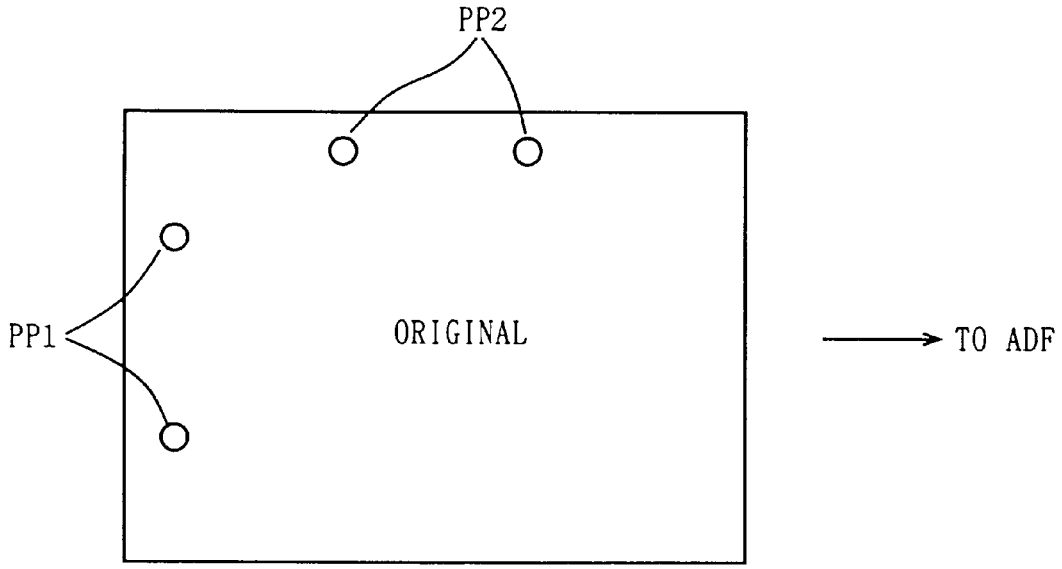
FIG. 10 is adapted to illustrate positions allowing punching.

FIG. 10 is adapted to illustrate punching.

When a punching function is set, the papers are punched after copying. Positions PP1 or PP2 are selected as the positions for punching.

<Operations of Respective Parts>

Figure 11:
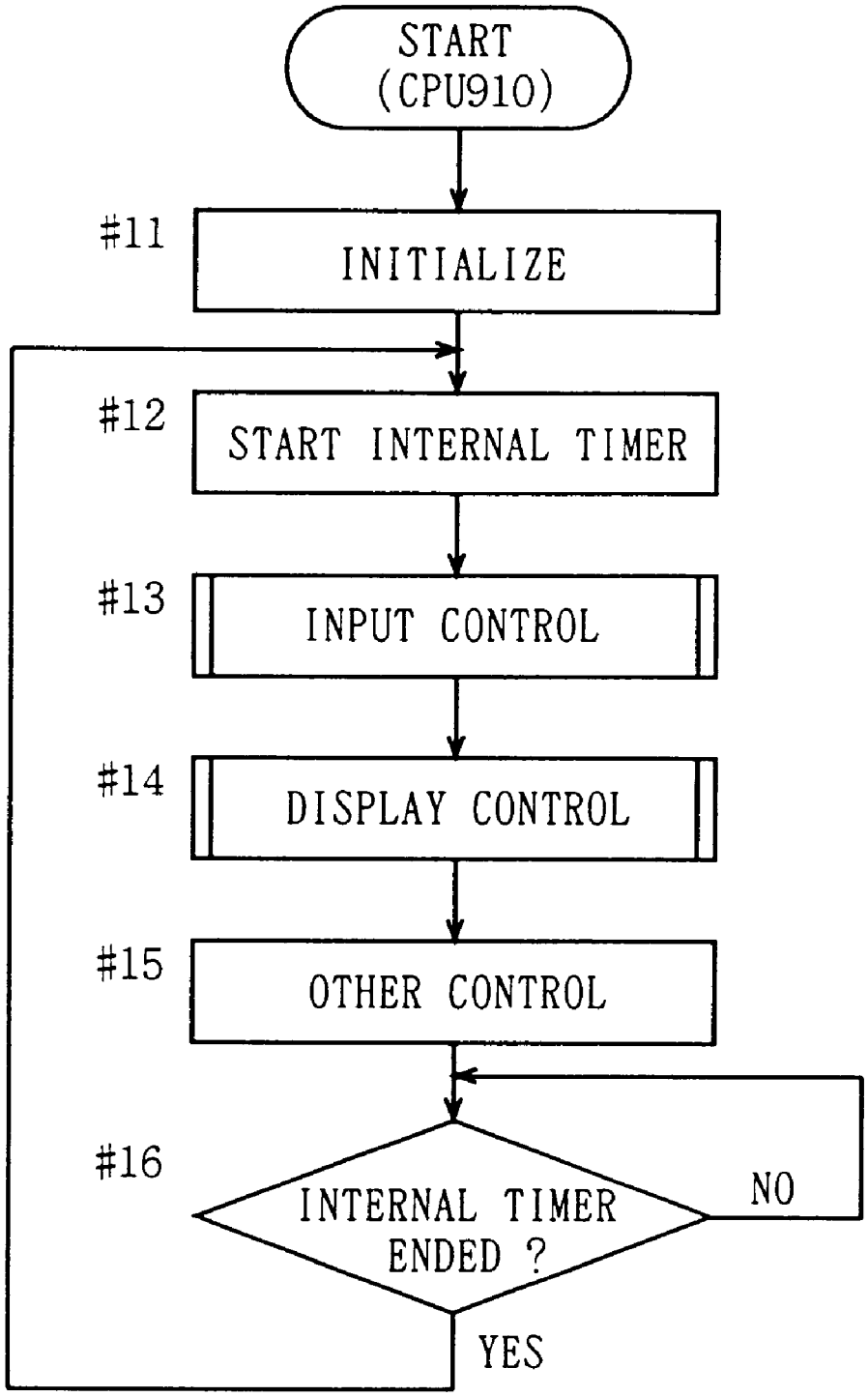
FIG. 11 is a flow chart showing the main routine of the copying machine.

FIG. 11 is a flow chart showing the main routine of the CPU 910 for the copying machine 10.

After initialization (step #11; the term "step" is hereinafter omitted), the CPU 910 starts an internal timer to monitor the copying machine 10 so that the routine time is constant (#12 and #16), performs input control processing and display control processing on the operation panel OP and the like (#13 and #14), and performs other processing (#15). The CPU 910 communicates with the remaining CPUs by interrupt processing.

Figure 15:
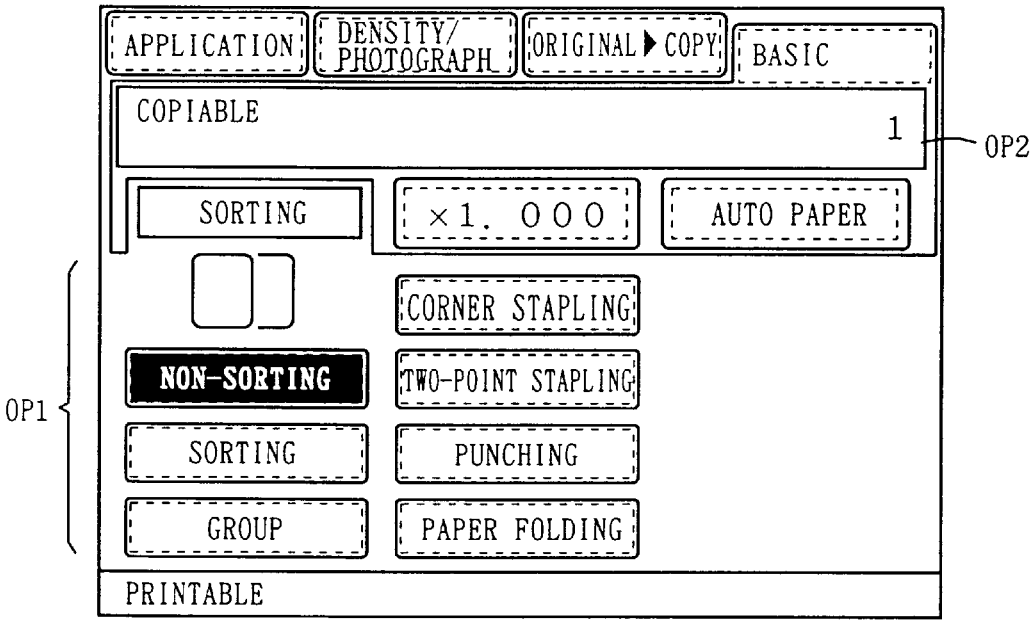
FIG. 15 illustrates a screen displayed in initialization.

In the initialization at #11, the liquid crystal touch panel 91 displays a screen shown in FIG. 15. In the screen shown in FIG. 15, the touch panel 91 displays function set keys OP1 and a copy number key OP2.

The function set keys OP1 include a non-sort key, a sort key, a group key, a corner stapling key, a two-point stapling key, a punching key and a paper folding key. The user can set each function by touching each key. The key corresponding to the set function is inversely displayed.

In the initialization, only the non-sort function is set as shown in FIG. 15.

Figure 12:
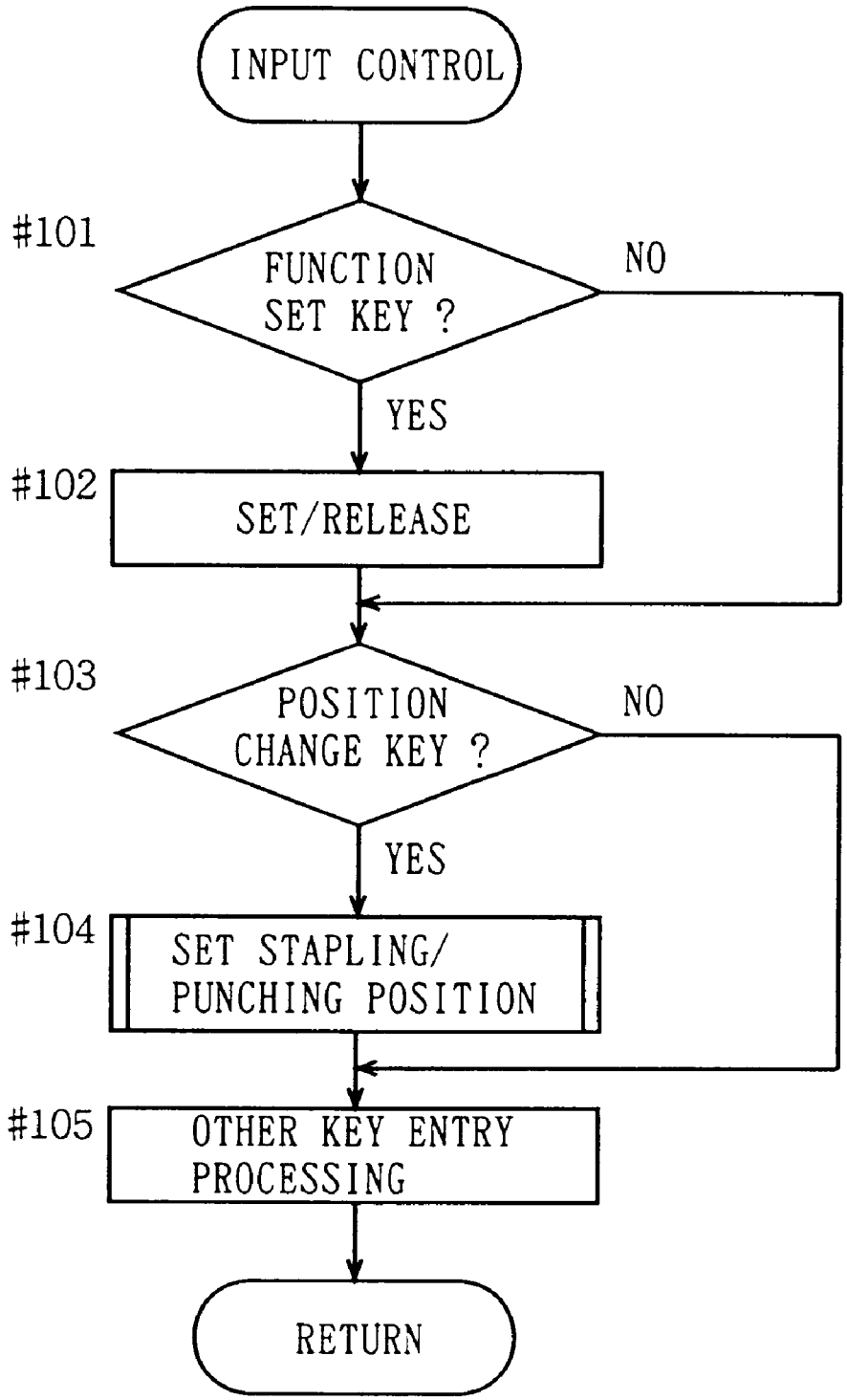
FIG. 12 is a flow chart showing an input control routine (#13) in FIG. 11.

FIG. 12 is a flow chart of the input control step (#13) shown in FIG. 11.

At #101, the CPU 910 determines whether or not any function set key OP1 is touched. If the determination is of YES, the function is set or released at #102.

Figure 16:
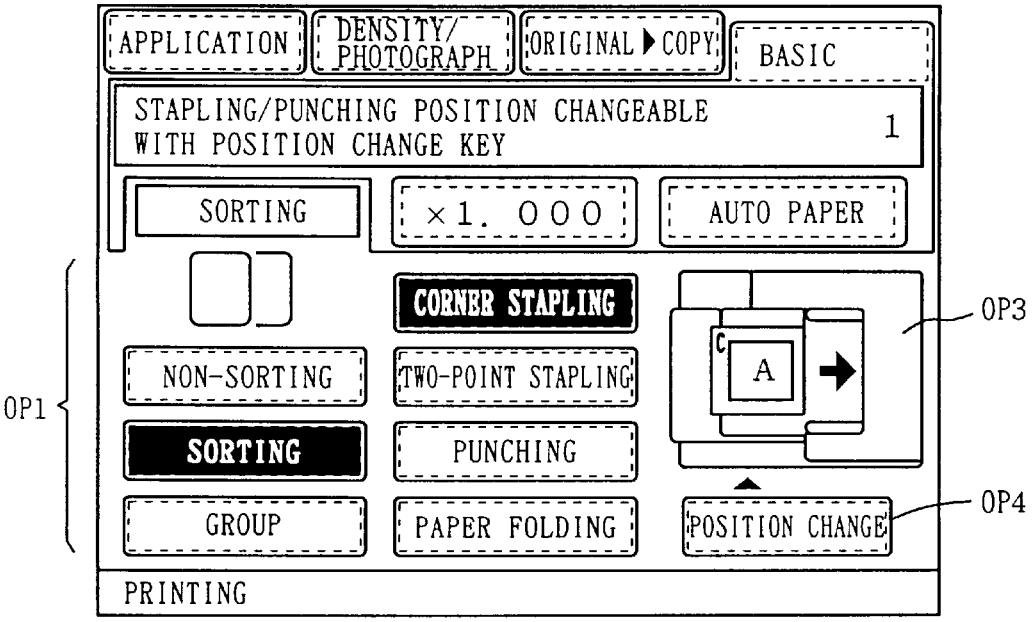
FIG. 16 illustrates a screen for selecting corner stapling.

At #103, the CPU 910 determines whether or not a position change key OP4 is touched. The position change key OP4, shown in FIG. 16, is adapted to change the position(s) for stapling or punching.

The position change key OP4 is displayed when any or two or more functions of corner stapling, two-point stapling, punching and paper folding are set. Simultaneously with the position change key OP4, the current processing position for stapling or the like is displayed on a position display image OP3. Referring to FIG. 16, the position SP1 shown in FIG. 8 is set in corner stapling.

Referring again to FIG. 12, the CPU 910 sets the stapling or punching position(s) at #104 if the determination at #103 is of YES, and performs other input processing at #105, and returns.

Figure 13:
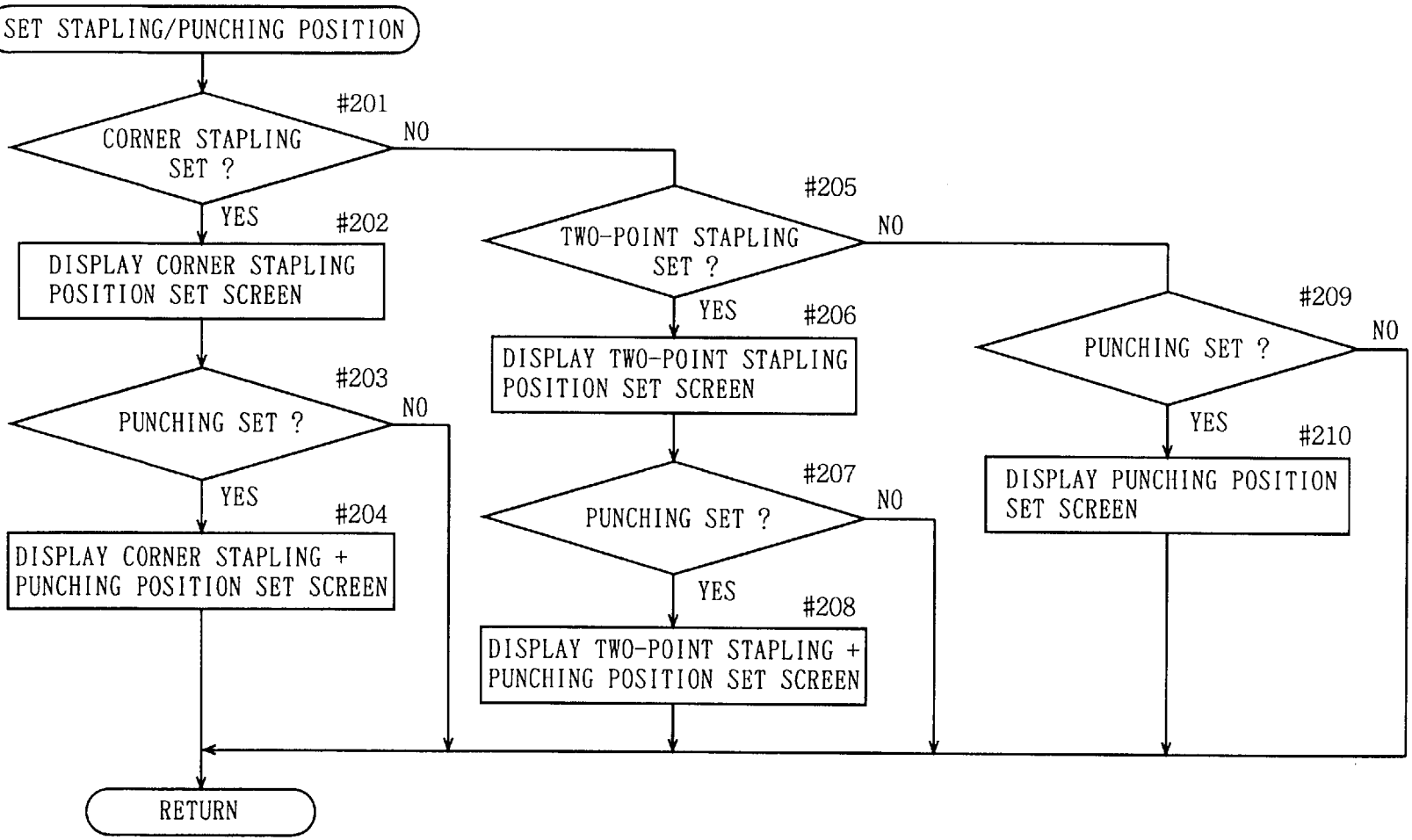
FIG. 13 is a flow chart showing the processing at a stapling/punching position setting step (#104) in FIG. 12.

FIG. 13 is a flow chart showing the stapling/punching position setting step (#104) in FIG. 12.

Figure 17:
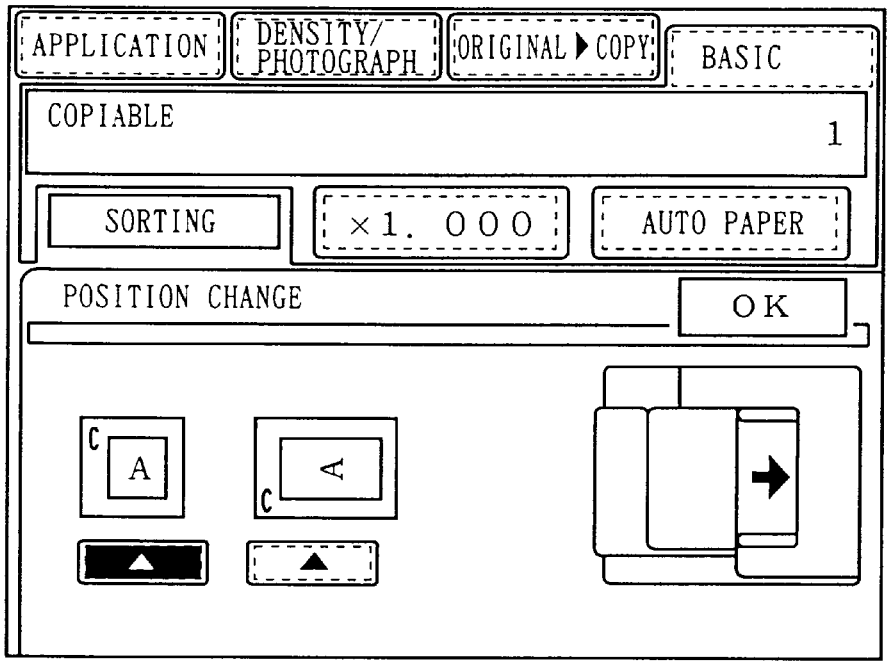
FIG. 17 illustrates a position change screen in corner stapling.

The CPU 910 determines at #201 whether or not corner stapling is set, and displays a corner stapling position set screen (FIG. 17) at #202 if the determination is of YES. In the screen shown in FIG. 17, the user can set the position SP1 or SP2 shown in FIG. 8 by touching the key.

Figure 18:
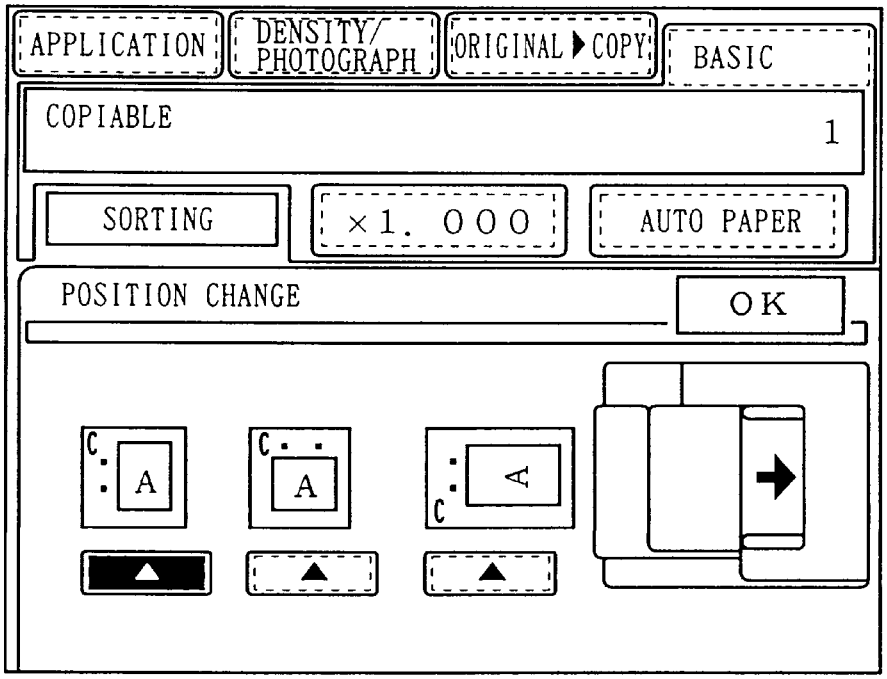
FIG. 18 illustrates a position change screen in a combination of the corner stapling and a punching function.

The CPU 910 determines at #203 whether or not the punching function is set in addition to the corner stapling function, and displays #204 a corner stapling and punching position set screen (FIG. 18) in place of the screen at #202 if the determination is of YES.

Referring again to FIGS. 8 and 10, four combinations of SP1+PP1, SP1+PP2, SP2+PP1 and SP2+PP2 are conceivable as to the corner stapling and the punching.

However, the combination of SP2+PP2 is meaningless since the papers cannot be opened when stitched through punchholes. Therefore, no key for setting such a meaningless combination is displayed on the screen shown in FIG. 18. Thus, the facility of the copying machine 10 is improved for the user.

After the setting, the user touches an OK key on the right center part of the screen for setting the function.

Figure 19:
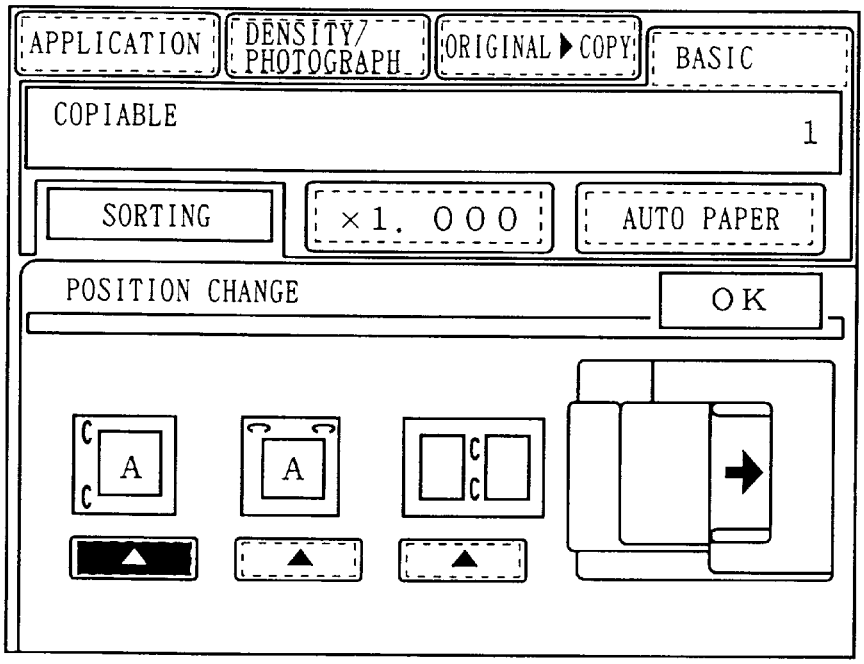
FIG. 19 illustrates a position change screen in two-point stapling.

If the determination at #201 is of NO, on the other hand, the CPU 910 determines at #205 whether or not two-point stapling is set. If the determination is of YES, the touch panel 91 displays a two-point stapling position set screen (FIG. 19) at #206. On the screen shown in FIG. 19, the user can select desired ones from the stapling positions SP3 to SP5 shown in FIG. 9.

The CPU 910 determines at #207 whether or not the punching function is set. If the determination is of YES, the touch panel 91 displays a two-point stapling and punching position set screen (FIG. 20) at #208.

Figure 20:
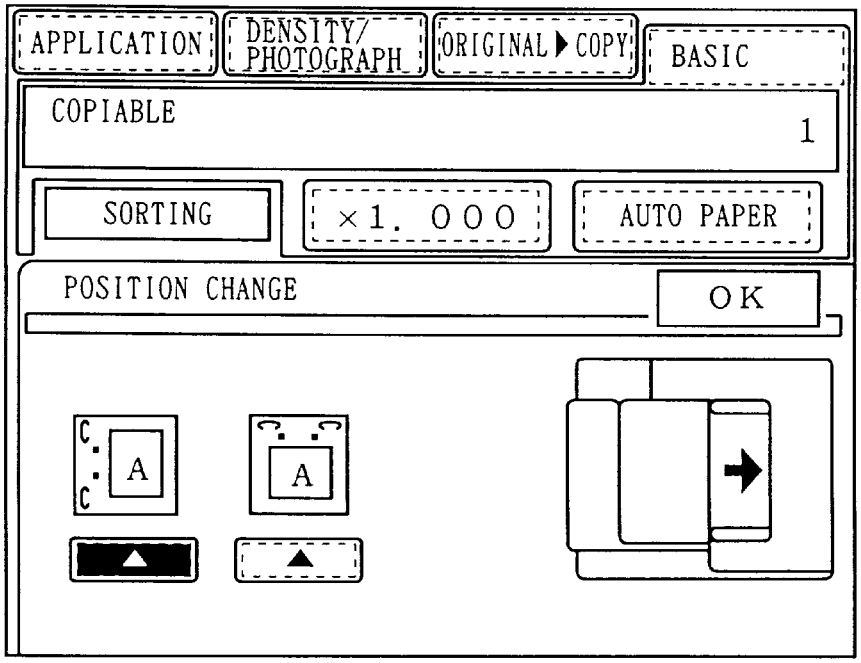
FIG. 20 illustrates a position change screen in a combination of the two-point stapling and the punching function.

While six (3×2) combinations including the three stapling positions SP3 to SP5 shown in FIG. 9 and the two punching positions PP1 and PP2 shown in FIG. 10 are conceivable in case of combining the two-point stapling and punching functions, only the combinations of SP3+PP1 and SP4+PP2 are meaningful among the six combinations. When the two-point stapling and punching functions are selected together, therefore, only the meaningful combinations are displayed as shown in FIG. 20, to be selected by the user.

Figure 21:
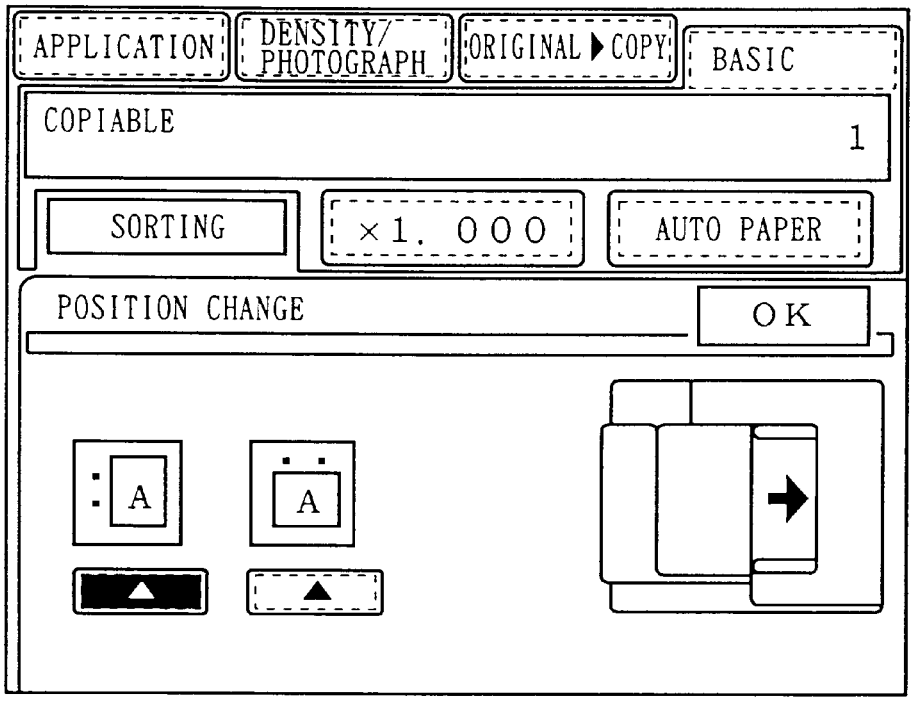
FIG. 21 illustrates a position change screen for the punching function.

If the determination at #205 is of NO, on the other hand, the CPU 910 determines at #209 whether or not the punching function is set. If the determination is of YES, the touch panel 91 displays a punching position set screen (FIG. 21) at #210.

Namely, the user selects the positions PP1 or PP2 shown in FIG. 10.

When a plurality of functions are combined with each other, the touch panel 91 displays proper combinations, so that the user can readily set the functions.

Figure 14:
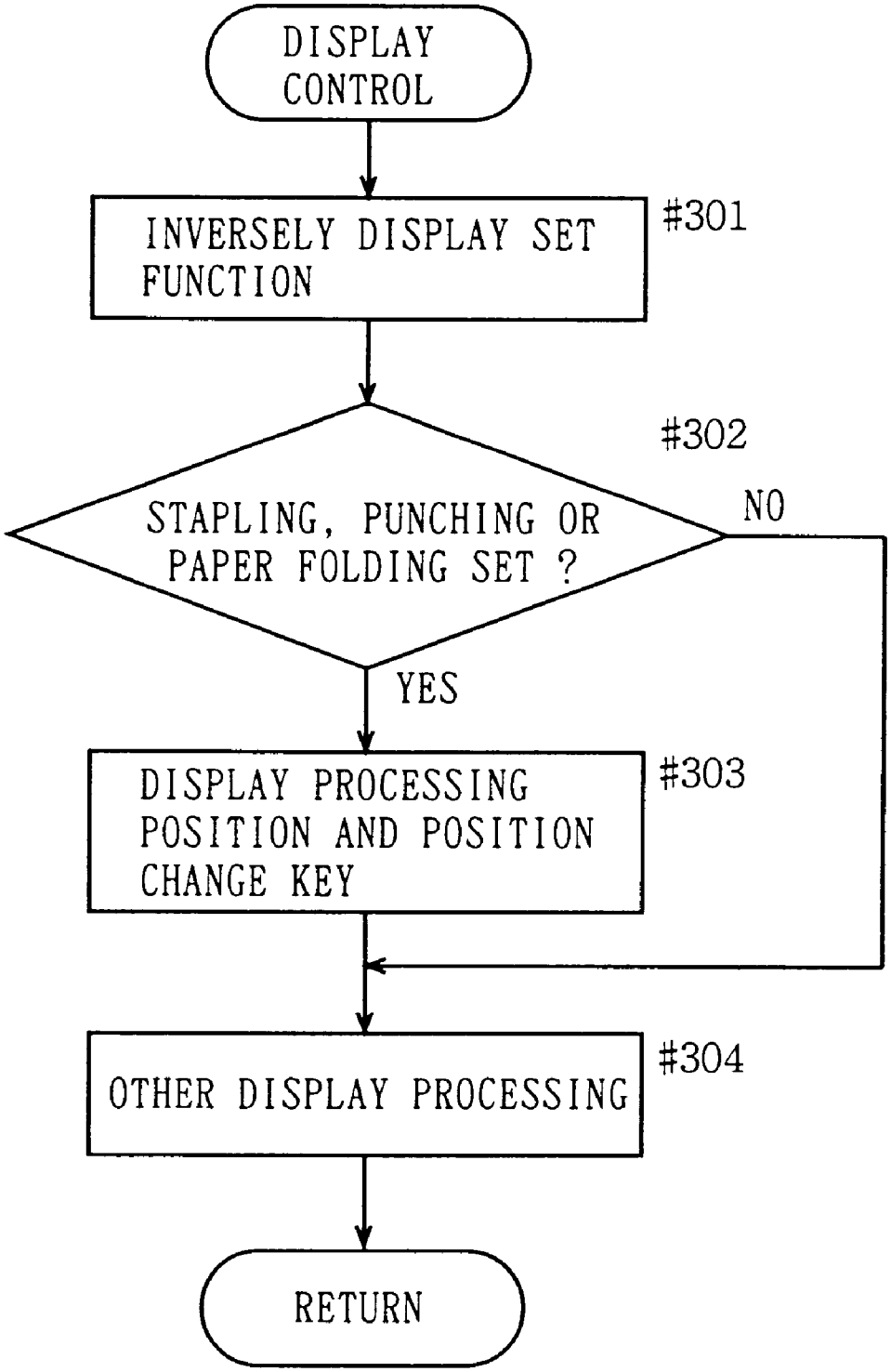
FIG. 14 is a flow chart showing the processing at a display control step (#14) in FIG. 11.

FIG. 14 is a flow chart showing the processing at the display control step (#14) in FIG. 11.

Referring to FIG. 14, the CPU 910 inversely displays the function set key OP1 corresponding to the set function at #301. Then, the CPU 910 determines at #302 whether the corner stapling, two-point stapling, punching or paper folding function is set. If the determination is of YES, the touch panel 91 displays the position display image OP3 and the position change key OP4 at #303.

The CPU 910 performs other display processing at #304, and returns.

[Modifications]

Figure 22:
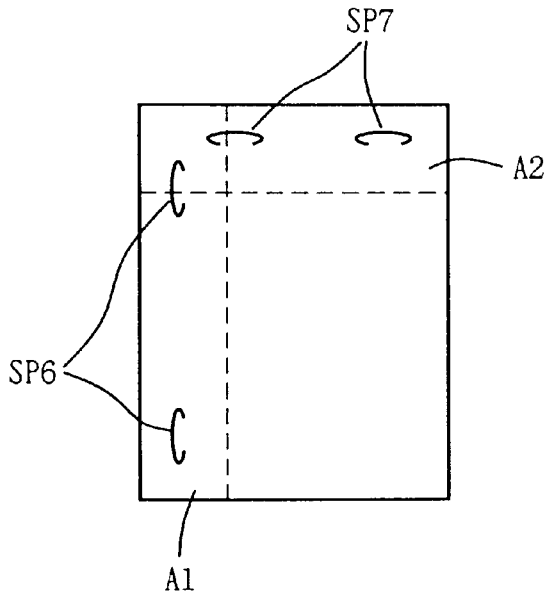
FIG. 22 is adapted to illustrate a first modification.

The aforementioned embodiment can be modified as follows:

FIG. 22 shows functions of a copying machine which can set a binding margin A1 or A2 on each paper and perform two-point stapling on positions SP6 or SP7.

When a two-point stapling function and a binding margin forming function are set, combinations of the stapling positions SP6 and the binding margin A2 and the stapling positions SP7 and the binding margin A1 are meaningless.

Figure 23:
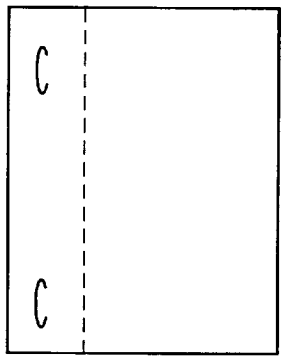
FIG. 23 is adapted to illustrate positions selectable from the state shown in FIG. 22.
Figure 24:
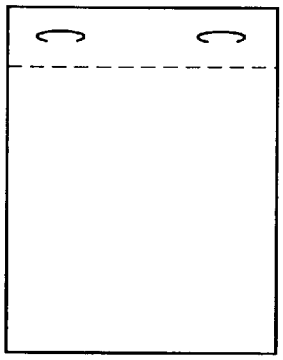
FIG. 24 is adapted to illustrate other positions selectable from the state shown in FIG. 22.

When the two-point stapling and binding margin forming functions are selected together, therefore, either the combination of SP6+A1 shown in FIG. 23 or the combination of SP7+A2 shown in FIG. 24 is displayed to be selected by the user, whereby the facility of the copying machine is improved.

Figure 25:
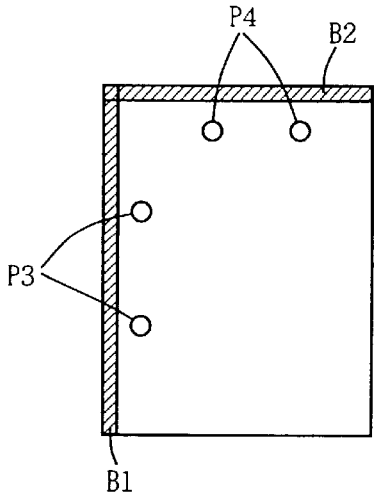
FIG. 25 is adapted to illustrate a second modification.

When a bookbinding function through pasting of a position B1 or B2 and a function of punching positions P3 or P4 are selected as shown in FIG. 25, combinations of B2+P3 and B1+P4 are meaningless.

Figure 26:
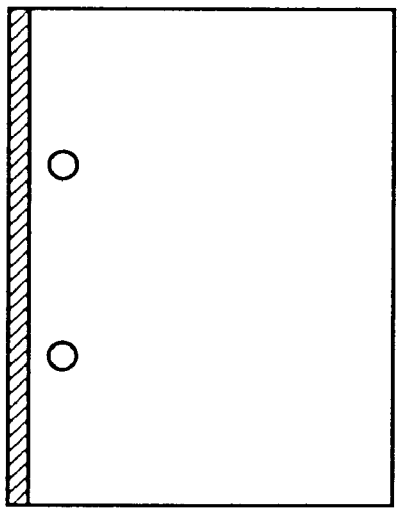
FIG. 26 is adapted to illustrate positions selectable from the state shown in FIG. 25.
Figure 27:
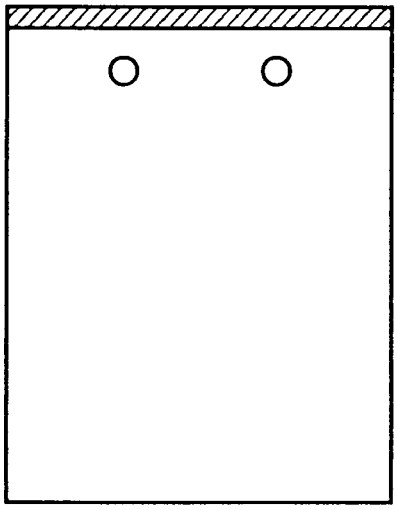
FIG. 27 is adapted to illustrate other positions selectable from the state shown in FIG. 25.

When the aforementioned functions are combined with each other, therefore, the combination of B1+P3 shown in FIG. 26 or the combination of B2+P4 shown in FIG. 27 is displayed to be selected by the user, whereby the facility of the copying machine is improved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a set unit alternatively or simultaneously setting a first process being performed on a sheet provided with an image and a second process being different from said first process, said set unit selectively setting a position on said sheet to be subjected to said first process from a plurality of positions while selectively setting a second position on said sheet to be subjected to said second process from a plurality of second positions; and a display unit selecting only proper combinations from combinations of said plurality of positions to be subjected to said first process and said plurality of second positions to be subjected to said second process and displaying the same when said set unit simultaneously sets said first and second processes.

2. The image forming apparatus in accordance with claim 1, wherein said first process is automatic stapling, and said second process is automatic punching.

3. The image forming apparatus in accordance with claim 1, wherein said first process is automatic stapling, and said second process is formation of a binding margin.

4. The image forming apparatus in accordance with claim 1, wherein said first process is automatic stapling, and said second process is automatic bookbinding.

5. The image forming apparatus in accordance with claim 1, wherein said display unit displays said proper combinations on a liquid crystal screen being provided on said image forming apparatus.

6. The image forming apparatus in accordance with claim 1, wherein combinations which are not displayed on said display unit cannot be set.

7. An image forming apparatus, comprising:

a first processing unit subjecting one of a plurality of first positions on a sheet provided with an image to a first process;

a second processing unit subjecting one of a plurality of second positions on a sheet provided with an image to a second process different from said first process; and a display unit displaying only proper combinations for simultaneously executing said first and second processes among combinations of said plurality of first positions and said plurality of second positions.

8. The image forming apparatus in accordance with claim 7, further comprising a set unit setting a first mode to execute said first process and/or a second mode to execute said second process based on instructions from a user, said display unit displaying said proper combinations when said first and second modes are both set by said set unit.

9. The image forming apparatus in accordance with claim 7, wherein the number of said proper combinations displayed by said display unit is smaller than the number of all the combinations of said plurality of first positions and said plurality of second positions.

10. The image forming apparatus in accordance with claim 7, wherein said first process is automatic stapling, and said second process is automatic punching.

11. The image forming apparatus in accordance with claim 7, wherein said first process is automatic stapling, and said second process is forming a binding margin.

12. The image forming apparatus in accordance with claim 7, wherein said first process is automatic stapling, and said second process is automatic binding.

13. An image forming apparatus comprising:

a first processing unit subjecting one of a plurality of first positions on a sheet provided with an image to a first process;

a second processing unit subjecting one of a plurality of second positions on a sheet provided with an image to a second process different from said first process;

first setting means for setting a first mode to execute said first process and/or a second mode to execute said second process based on instructions from a user;

a display unit displaying only proper combinations for simultaneously executing said first and second processes among combinations of said plurality of first positions and said plurality of second positions when said first and second mode are both set by said first setting means; and second setting means for setting positions on said sheet to be subjected to said first and second processes based on one combination selected by the user among said proper combinations displayed by said display unit.

14. The image forming apparatus in accordance with claim 13, wherein the number of said proper combinations displayed by said display unit is smaller than the number of all the combinations of said plurality of first positions and said plurality of second positions.

15. The image forming apparatus in accordance with claim 13, wherein said first process is automatic stapling, and said second process is automatic punching.

16. The image forming apparatus in accordance with claim 13, wherein said first process is automatic stapling, and said second process is forming a binding margin.

17. The image forming apparatus in accordance with claim 13, wherein said first process is automatic stapling, and said second process is automatic binding.

18. An apparatus controlling a finisher which selectively or simultaneously subjects a sheet provided with an image to a first process and a second process different from said first process, comprising:

first setting means for setting a first mode to make the finisher execute said first process;

second setting means for setting a second mode to make said finisher execute said second process;

a display unit displaying positions on said sheet to be subjected to said first and second processes; and a processing unit making said display unit display only proper combinations for simultaneously executing said first and second processes among combinations of a plurality of first positions on said sheet which can be subjected to said first process and a plurality of second positions on said sheet which can be subjected to said second process.

19. The apparatus in accordance with claim 18, wherein said processing unit sets positions to be subjected to said first and second processes based on one combination selected by a user among said proper combinations displayed on said display unit.

20. The apparatus in accordance with claim 18, wherein said display unit graphically displays positions on said sheet to be subjected to said first and second processes.

21. The apparatus in accordance with claim 18, wherein the number of said proper combinations is smaller than the number of all the combinations of said plurality of first positions and said plurality of second positions.

22. The apparatus in accordance with claim 18, wherein said first process is automatic stapling, and said second process is automatic punching.

23. The apparatus in accordance with claim 18, wherein said first process is automatic stapling, and said second process is automatic binding.

24. A method of controlling an image forming system which selectively or simultaneously subjects a sheet provided with an image to a first process and a second process different from the first process comprising the steps of:

setting a first mode to execute said first process according to instructions from a user;

setting a second mode to execute said second process according to instructions from the user; and displaying on a screen of a display unit only proper combinations for simultaneously executing said first process and said second process among combinations of a plurality of first positions on said sheet which can execute said first process and a plurality of second positions on said sheet which can execute said second process.

25. The method in accordance with claim 24, further comprising a step of setting positions to be subjected to said first and second processes based on one combination selected by the user among said proper combinations displayed by said display unit.

26. The method in accordance with claim 24, further comprising a step of graphically displaying said proper combinations.

27. The method in accordance with claim 24, wherein the number of said proper combinations is smaller than the number of all the combinations of said plurality of first positions and said plurality of second positions.

28. The method in accordance with claim 24, wherein said first process is automatic stapling and said second process is automatic punching.

29. The method in accordance with claim 24, wherein said first process is automatic stapling and said second process is forming a binding margin.

30. The method in accordance with claim 24, wherein said first process is automatic stapling and said second process is automatic binding.

* * * * *